United States Patent [19]

Finn

[11] Patent Number: 4,821,356

[45] Date of Patent: Apr. 18, 1989

[54] MILITARY BAYONET AND SCABBARD

[75] Inventor: Charles A. Finn, Oceanside, Calif.

[73] Assignee: Phrobis III, Ltd., Carlsbad, Calif.

[21] Appl. No.: 25,334

[22] Filed: Mar. 13, 1987

[51] Int. Cl.[4] ..... B25F 1/04

[52] U.S. Cl. ..... 7/134; 7/151; 7/158; 30/342; 42/86

[58] Field of Search ..... 42/52, 53, 86, 90; 30/340, 342, 123, 142, 143, 146, 194; 81/467, 471, 448, 477; 7/117, 125, 132, 134, 158, 166, 151

[56] References Cited

U.S. PATENT DOCUMENTS

| | | | |
|---|---|---|---|
| 57,677 | 9/1866 | Clayton | 30/342 |
| 2,688,143 | 9/1954 | Stoa | 7/156 |
| 3,201,869 | 8/1965 | Gambino | 30/342 |
| 3,842,458 | 10/1974 | Bauer | 7/134 |
| 4,458,420 | 7/1984 | Davis | 30/342 |
| 4,690,315 | 9/1987 | Bianchi | 224/252 |

*Primary Examiner*—Roscoe V. Parker
*Attorney, Agent, or Firm*—John E. Wagner

[57] ABSTRACT

A bayonet and scabbard are capable of being pivotally connected to constitute a wire or metal tape cutting implement having a recess shaped to capture the wire or tape before such cutting begins. The bayonet blade has a tang extending into the bayonet handle which is of a yield strength greater than that of the handle but less than that of the bayonet blade. A finger guard is provided with notches adjacent the blade for engaging an edge of the cap of a receptacle for removing the same.

31 Claims, 7 Drawing Sheets

62
65
63
66
60
70
61
41
40
71
73
72
72R
42
74
92
75
76
80
81
86
82
84
89
83
85
192
175
190
181
182
177
176
189
74A
74B
14A
193
10°
77

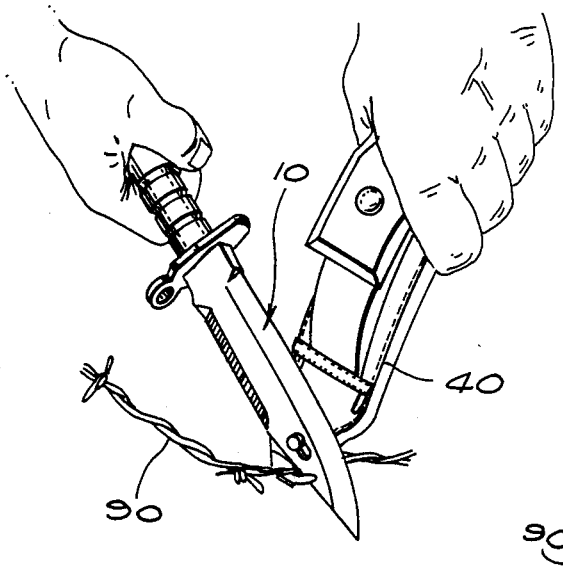
FIG. 6
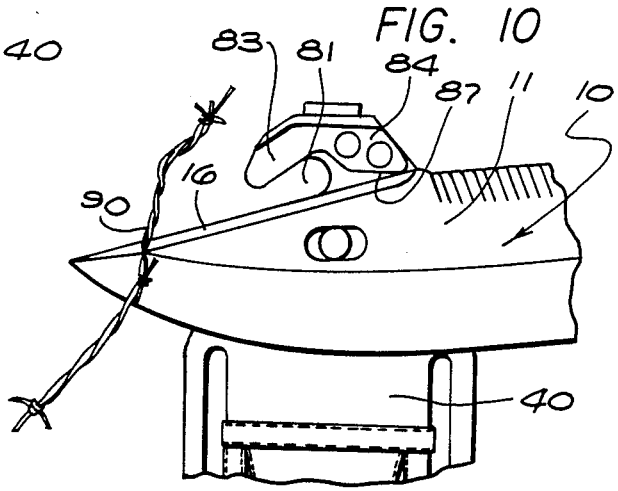
FIG. 10
FIG. 11
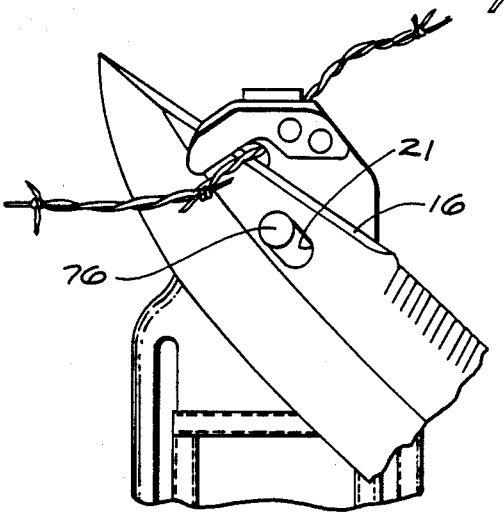
FIG. 12
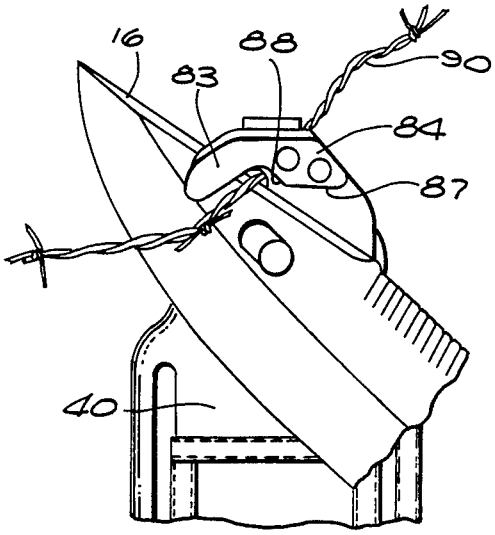
FIG. 13
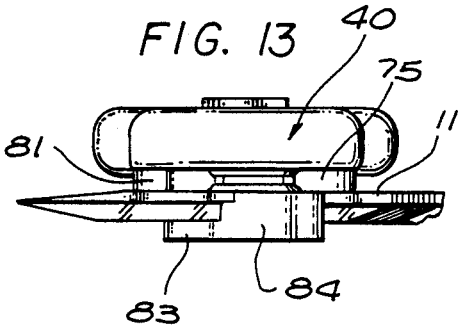

MILITARY BAYONET AND SCABBARD

BACKGROUND OF THE INVENTION

The bayonet has been an infantryman's additional weapon from earliest times and, in fact, is an outgrowth of the pike, the first infantryman's weapon. The bayonet has evolved, changed in length, changed in method of attachment and other details through the years without significant improvement. Bayonets have had a primary function in close hand to hand combat affixed to the barrel of the basic military rifle.

Recently the need has been recognized for a multipurpose bayonet which must serve the functions of a bayonet, a military field knife, a combat knife and also a sawing and wire cutting instrument. These requirements have been recognized in recent U.S. military specifications such as Mil-K 70606 Mar. 21, 1986.

Some of the requirements tend to be contradictory in the design parameters. For example, a bayonet with a sharp blade which maintains its sharpness tends to be brittle and subject to fracturing if used as a prying tool. A bayonet which is long for greater reach on a rifle becomes unwieldy when used as a knife. A bayonet with a suitable sharp edge for cutting barbed wire becomes dulled after repeated use and can not cut cables by mere sawing action alone.

It has been proposed to use a bayonet blade when pivotally interlocked with a rigid scabbard similar to that disclosed in my design patent application Ser. No. 766,101 filed Aug. 15, 1987 as a scissor type wire cutter.

Such an arrangement is shown in U.S. Pat. No. 3,842,458 of R. E. Bauer. The scabbard is releasably connected to a belt by a clip of the type disclosed in the U.S. patent of Bianchi U.S. Pat. No. 4,690,315 issued Sept. 1, 1987. The Bauer patent describes prior bayonets of that type which use a notched cutter plate on the scabbard and an unnotched blade as unreliable since the wire or cable to be cut may slip out of the scabbard plate notch. The Bauer patent proposes the use of a notched hardened steel blade cooperating with the notched scabbard plate as the solution to the wire slippage problem. The Bauer patent further discloses the blade as keyed to the scabbard during cutting operation.

BRIEF STATEMENT OF THE INVENTION

I recognized that the bayonet can be designed to meet these conflicting requirements and should, in addition to its use affixed to the barrel of a rifle, act effectively as a combat knife, a survival knife for the infantryman and additionally, act, if the occasion arises, as an effective wire and cable cutter and an effective prying tool, bottle or can opener and saw without danger of breakage or premature dulling of the blade.

If the bayonet is to be used as a prying tool, it must exhibit resiliency not found in hardened steel knife blade edges.

My invention involves a bayonet, having a blade length between 6 and 8 inches, having a cutting edge and a hollow ground rear edge which includes a cutter blade toward the tip and saw teeth similar to the survival knife disclosed in my U.S. Pat. No. 4,622,707 issued Nov. 18, 1986. The blade is manufactured of hardened steel. The blade, in the tip region, has an oval opening therethrough which cooperates with a pin on the exterior of its sheath to provide a pivot for a wire cutter. A U shaped recess in a hardened plate on the sheath provides the shearing surface for heavy wire or cable cutting. An arm secured to the cutter plate overhangs the blade and holds it in cutting relationship with the cutter plate.

The knife blade includes a short tang which is secured to a tang rod which acts as a core for the handle. The rear of the handle is secured to the tang rod or extension by a threaded adapter which loads the tang rod in tension. The tang rod is manufactured of a stainless steel having a higher degree of resiliency than the bayonet blade whereby any deflective forces on the handle, if it exceeds the predetermined load on the blade, will cause the handle and tang rod to deflect rather than applying fracturing stress on the blade. At first glance, a bending handle would appear to be unacceptable, but in fact such a property insures that the bayonet may be used for prying without danger to the blade.

I have also provided two different wire and strap cutter arrangements using the bayonet scabbard as one handle mounting a cutter plate. I have determined that an effective solution to wire slippage in the wire cutter application of my new bayonet does not require blade notching. In my bayonet scabbard, the cutter plate employs a deep notch in the cutter plate and an overlying arm of length greater than the notch depth. The overlying ar and the cutter plate embrace the blade and securely lock the wire to be cut in the plate notch prior to cutting. This avoids the apparent problem of prior art cutters in which the cutting action tended to push the wire out of the notch. Furthermore, the wire cutting blade and cutter plate cutting surface each include a minor (10, for example) draft angle which serves to urge the blade and cutter plate together rather than apart during the cutting operation. This eliminates the need for keying the blade scabbard.

In another and referred embodiment, the blade is secured to the scabbard cutter plate by a T headed pivot, similar in certain respects to that shown in the Bauer patent and providing a changable cutting surface by means of an enlarged blade opening. It further provides for blade clearance adjustment for wear.

Altogether, my bayonet provides each of the required functions of a modern bayonet without compromising its basic function.

BRIEF DESCRIPTION OF THE DRAWING

This invention may be more clearly understood by reference to the following detailed description and the drawing in which:

FIG. 6 is a perspective view of this bayonet being used as a wire cutter;

FIG. 10 is a fragmentary side elevational view of the bayonet and scabbard of this invention ready for cutting a wire or cable;

FIG. 11 is a fragmentary side elevational view similar to FIG. 10 with barbed wire trapped just prior to cutting;

FIG. 12 is a fragmentary side elevational view similar to FIG. 11 with a different area of cutting surface in use;

FIG. 13 is a fragmentary bottom end view of the bayonet and scabbard of this invention in cable cutting arrangement;

DETAILED DESCRIPTION OF THE INVENTION

The Bayonet Generally

Figure 1:
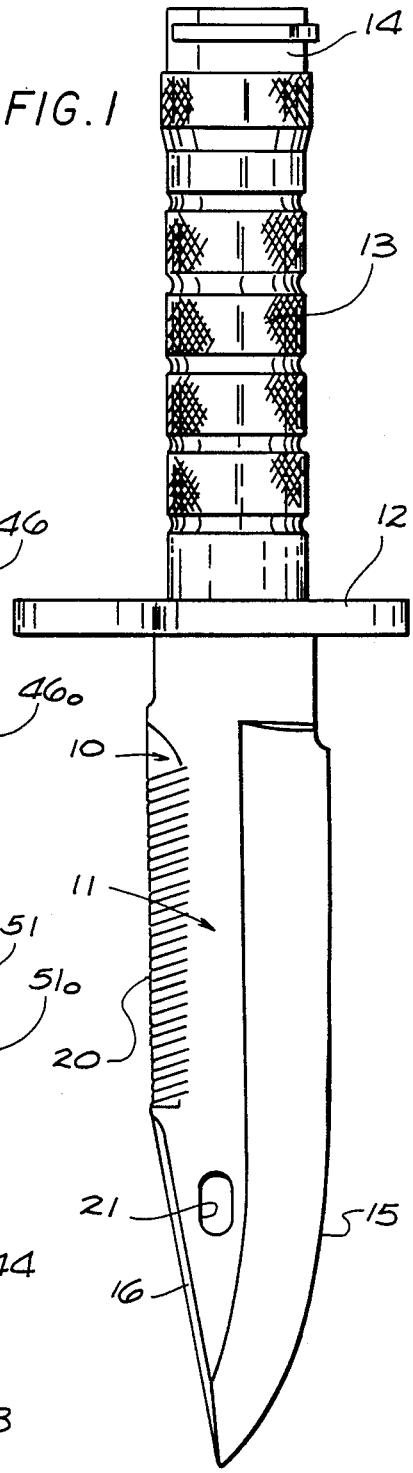
FIG. 1 is a side elevational view of the bayonet of this invention.
Figure 2:
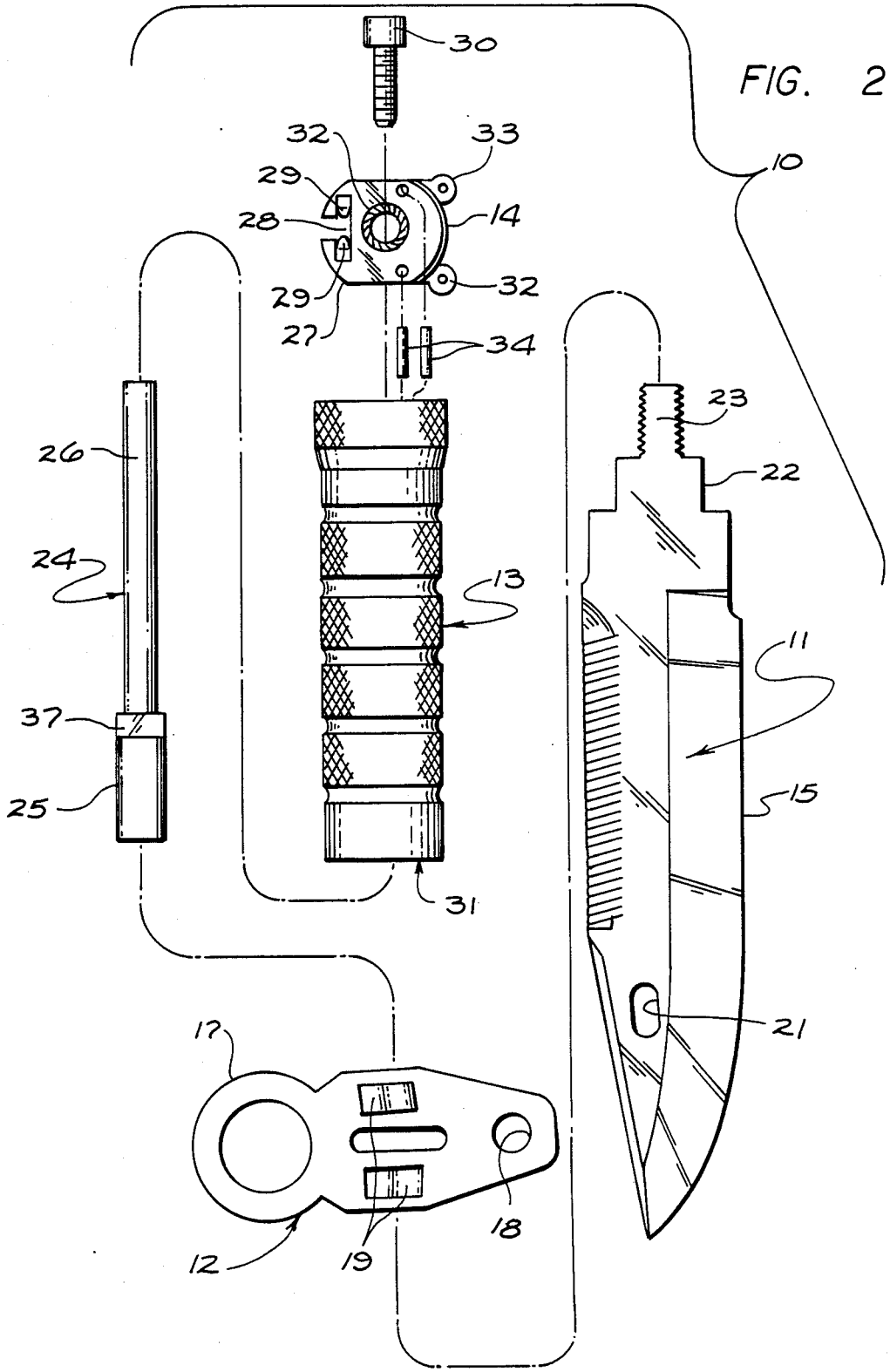
FIG. 2 is an exploded view thereof.

Now referring to FIGS. 1 and 2 of the drawing, a bayonet 10 is shown including a blade 11, a finger guard 12, a handle 13 and a latching mechanism 14, the latter of which is designed to engage the bayonet mounting lug of an M 16 rifle or other military type weapon.

The blade 11 includes a primary cutting edge 15 which is hollow ground, a single beveled shearing blade 16, a set of recessed teeth 20 forming a saw and an elongated opening 21 used in connection with the scabbard for shearing or cutting of cables or heavy wire. The blade is fabricated of type 425 stainless steel produced by the Allegany Ludlum Steel Co. and preferably has a shot peened or other finish providing a low reflective surface and good abrasion and corrosion resistance.

The blade 11 is given a heat treatment to provide each of the cutting surfaces a Rockwell C hardness of 58 to 59 with the main body of the blade having a hardness of 54 to 55 Rockwell C. The rear of the blade 11 includes a short rectangular tang 22, unshown in FIG. 1 but appearing in FIG. 2, which extends through the fingerguard 12 and into the handle 13 The tang 22 which has a hardness in the order of 38-40 Rockwell C terminates in a threaded end 23 into which a tang rod or extension 24 may be threaded.

The tang rod or extension 24 includes a union portion 25 internally threaded to match the tang end 23 and joins the main body 26 of the tang extension 24. The main body 26 of the tang extension 24 is likewise internally threaded at opposite ends to receive the handle 13 and attachment mechanism 14 and securing screw 30. The tang extension 24 extends through an opening 31 in the handle 13. The screw 30 extends into a mating recess 32 in the attachment mechanism 14 and applies compressive stress on the attachment mechanism 14 and handle 13, the latter of which bears against the rear face of finger guard 12 while tensioning the tang extension 24.

The screw 30 provides a primary function maintaining the entire knife 10 assembled and allows for its disassembly into the form shown in FIG. 2 by its removal using a hex wrench or screw driver. The relationship of the parts interior to the handle 13 is best illustrated in FIGS. 8A–C and is described below, in connection with those figures.

The finger guard 12 is best seen in FIG. 2 as including an integral ring 17 for encircling the barrel of the weapon, a lanyard ring 18 and a pair of prying slots 19 on opposite sides of the blade, particularly useful in opening capped containers.

The attachment mechanism 14 includes a body 27 defining a slot 28 into which a pair of spring loaded pawls 29 extend. The pawls are retracted out of slot 28 by compressing their handle portion 32 and 33 together against the resistance of an internal compression spring (unshown). This attachment mechanism 14 allows the bayonet 10 to be slipped over the end of the barrel and onto a conventional bayonet mounting lug found on American military rifles and other weapons. The attachment mechanism 14 is secured from rotation with respect to handle 13 by a pair of split pins 34 which extend through the attachment mechanism 14 into mating recesses (unshown) in the end of handle 13.

The tang extension 24 as described above is maintained in tension by the screw 30 when the bayonet is assembled. The tang extension 24 is fabricated of 300 series (303 and 304 types recommended) stainless steel having a yield strength of the order of 35,000 psi and in the preferred embodiment, has a diameter of, for example, 0.375+0.002 in., and overall length of approximately 4 inches and a length of the rod portion 26 of 3 inches. The union portion 25 has a diameter in the order of ⅝ inch and a pair of flats 37 one of which appears in FIG. 2 used to allow a wrench to tighten the tang extension 24 onto the tang 23 of the blade 11 to a torque of the order of 200 in lbs.

The tang rod 24 extends through a clearance opening 38 in the handle 13 of, for example, 0.390 inch diameter surrounding the rod section 26 and having a ½ degree taper outward from the rear of the handle to the front.

The tang extension 24 is not heat treated to change its normal resiliency and hardness.

The handle 13 is preferably fabricated from Dupont "Zytel" ST8018 glass filled Nylon and a yield strength in the order of 10,000 psi at normal ambient conditions. It has a total of 5 knurled sections separated by grooves. The cooperation of the handle 13 with the tang rod or extension 24 cooperating further with the finger guard 12 and blade 11 and the attachment 14 by securing screw 30 is responsible for the blade saving capabilities of this invention. This feature is described in connection with FIGS. 8–9.

The Bayonet as a Prying Tool

As indicated above the soldier's bayonet is often needed for prying as well as twisting purpose despite the fact that ideally designed blade can be fractured by either of those motions. However, illustrated in FIG. 8 A–C, bending loading placed upon the blade 11 of this invention allows the handle 13 and tang rod 24 to bend as the blade approaches excessive loading. This signals to the user to avoid greater loading which might result in blade fracture although unlikely since the handle 13 and tang rod 24 will absorb additional loading by further deformation.

Figure 8:
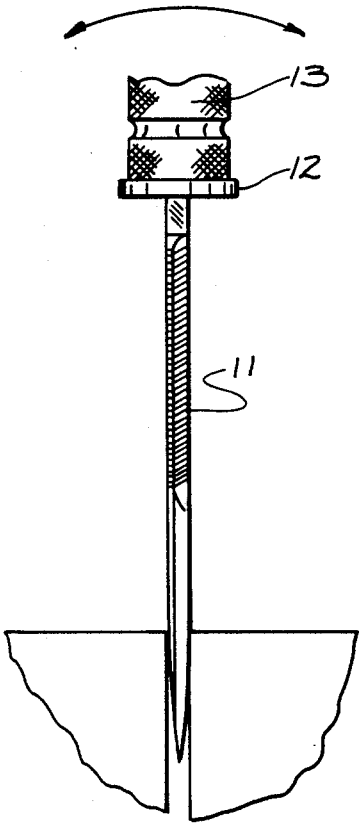
FIG. 8 is a top plan view of the bayonet of this invention shown under bending loading.
Figure 8A:
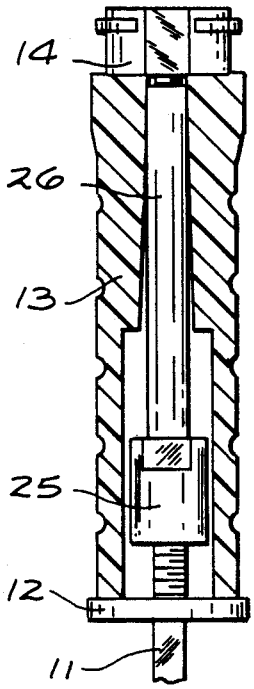
FIG. 8A is a fragmentary sectional view of the handle portion of this invention shown in its normal unstressed condition.
Figure 8B:
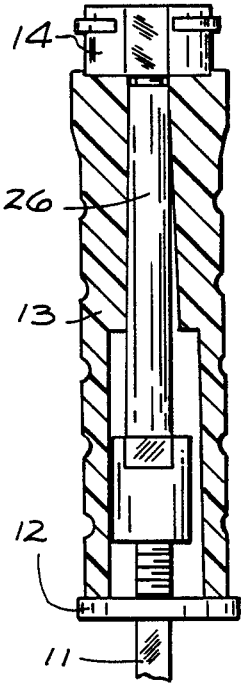
FIG. 8B is a view similar to FIG. 8A under moderate bending loading as illustrated in FIG. 8.
Figure 8C:
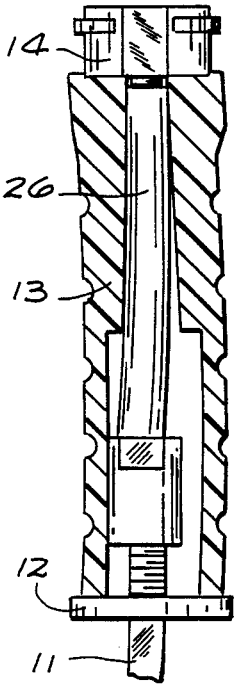
FIG. 8C is a view similar to FIG. 8A under further bending loading.
Figure 9A:
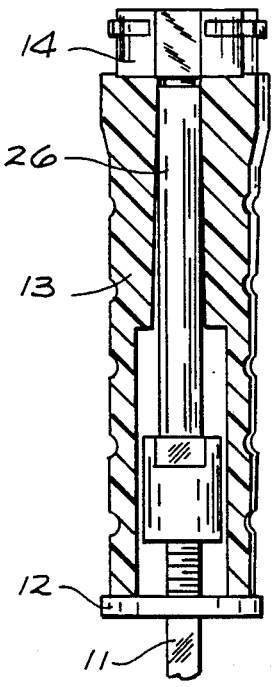
FIG. 9A is a fragmentary sectional view of the handle portion of this invention under torsional loading.

FIG. 8 shows a typical prying situation with the tip of blade 11 inserted in a vise-like device. Prying is accomplished by applying force to the handle in either of the directions of the arrow in FIG. 8. As shown in FIG. 8A, tapered clearance exists between the tang extension 24 and the wall of the aperture.

In FIG. 8, the handle 13 has deflected until it engages the tang extension 24. The apparent stiffness to the user of the handle to the user then increases as further deflection results in the tang extension 24 bending. The material, dimensions and heat treatment of the tang extension 24 are selected so that its resiliency is greater than that of the blade 11 resulting in handle 13 bending prior to any danger of blade fracturing. Thus the soldier is warned by the apparent stiffening of handle 13 of any approach to blade endangering loading.

Extensive testing of the bayonet has been performed in which one and one half inches of the pointed end of the blade was held between rigid supports and the handle 13 on the bayonet repeatedly deflected to a minimum arc of one and a quarter inches to the left and to the right and held without blade fracturing.

Figure 9:
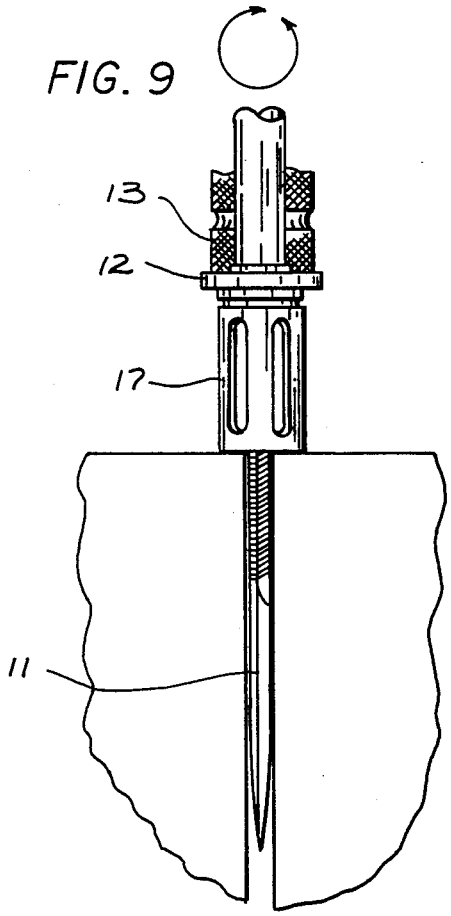
FIG. 9 is a top plan view showing the blade under torsional loading.

Similarly the bayonet has been tested by twisting as illustrated in FIG. 9 with one and half inches of the end of the blade measured from the finger guard or quillon end held. Twenty-five foot pounds, (thirty-five Newtons-Meter) torque was applied to the handle 13, both clockwise and counter- clockwise direction without encountering fracturing of the blade. These test procedures serve to demonstrate the fact that significant twisting and bending forces can be applied to the blade without fracturing even though the blade has been hardened to the required hardness to maintain the cutting edge, the shearing edge, and the saw edge. In use, as a knife, by the military man any tendency to over stress the blade will be felt in his hand by the deflection of the handle prior to the fracture inducing loading of the blade 13.

THE SCABBARD

Figure 3:
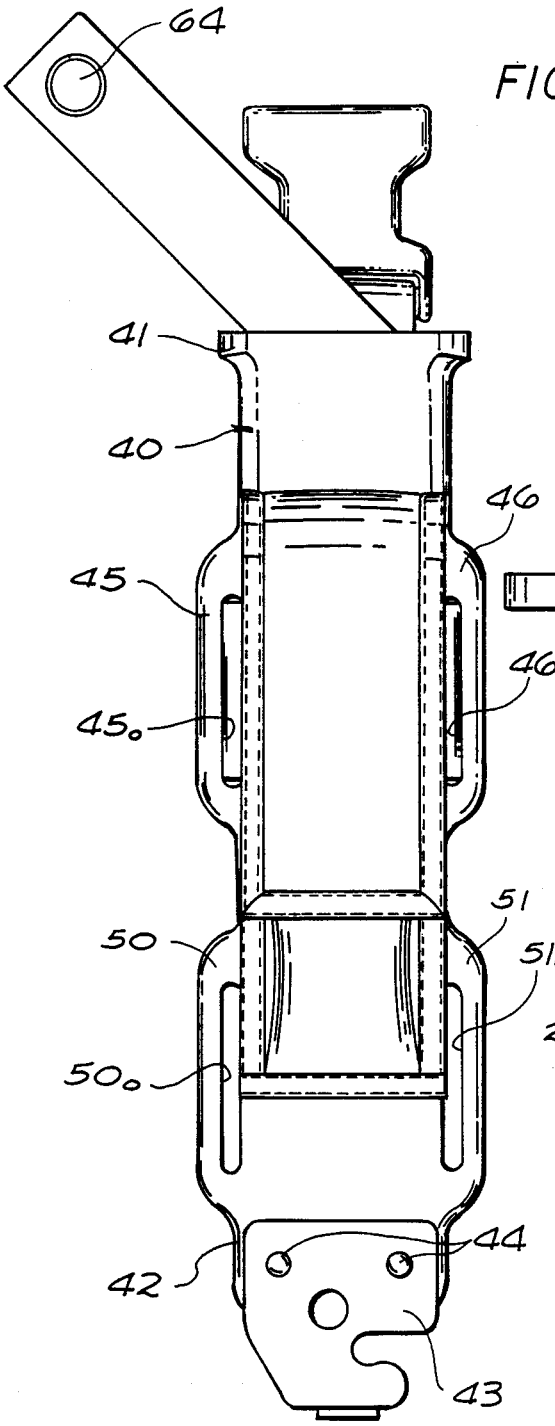
FIG. 3 is a side elevational view of the scabbard for the bayonet of this invention.

Another feature of this invention is best illustrated by reference to FIG. 3 in conjunction with FIG. 6 in which the bayonet is used as a cable cutter. The bayonet 10 is normally housed in a scabbard or sheath 40 shown in FIGS. 3 and 4. The sheath is similar to the sheaths shown in my design patent application Ser. No. 766,101 filed Aug. 15, 1985. It constitutes, in its preferred form, a molded plastic body 40 including an upper flared end 41 and a lower extension 42 carrying a cutter mechanism 43 which is secured to the body 40 by a pair of machine screws 44. The body 40 includes a pair of side flanges 45 and 46 towards the upper end and a second pair of flanges 50 and 51 towards the lower end of the bayonet. The side flanges 45, 46, 50, & 51 each include openings therethrough 45o, 46o, 50o, and 51o through which straps may extend for securing the bayonet sheath to baggage or other implements. The scabbard 40 is preferrably fabricated from plastic material such as, ST801, a glass filled Nylon resin produced by the Dupont de Nemours company of Wilmington, Del. The scabbard 40 includes an internal spring unshown in FIG. 2 which applies a mechanical bias against the side of the bayonet blade as it is inserted into the sheath 40 to secure the bayonet 10 within the sheath 40 under all norma circumstances.

Figures 4, 14, 14A, 15, 16, 17, 18, 19:
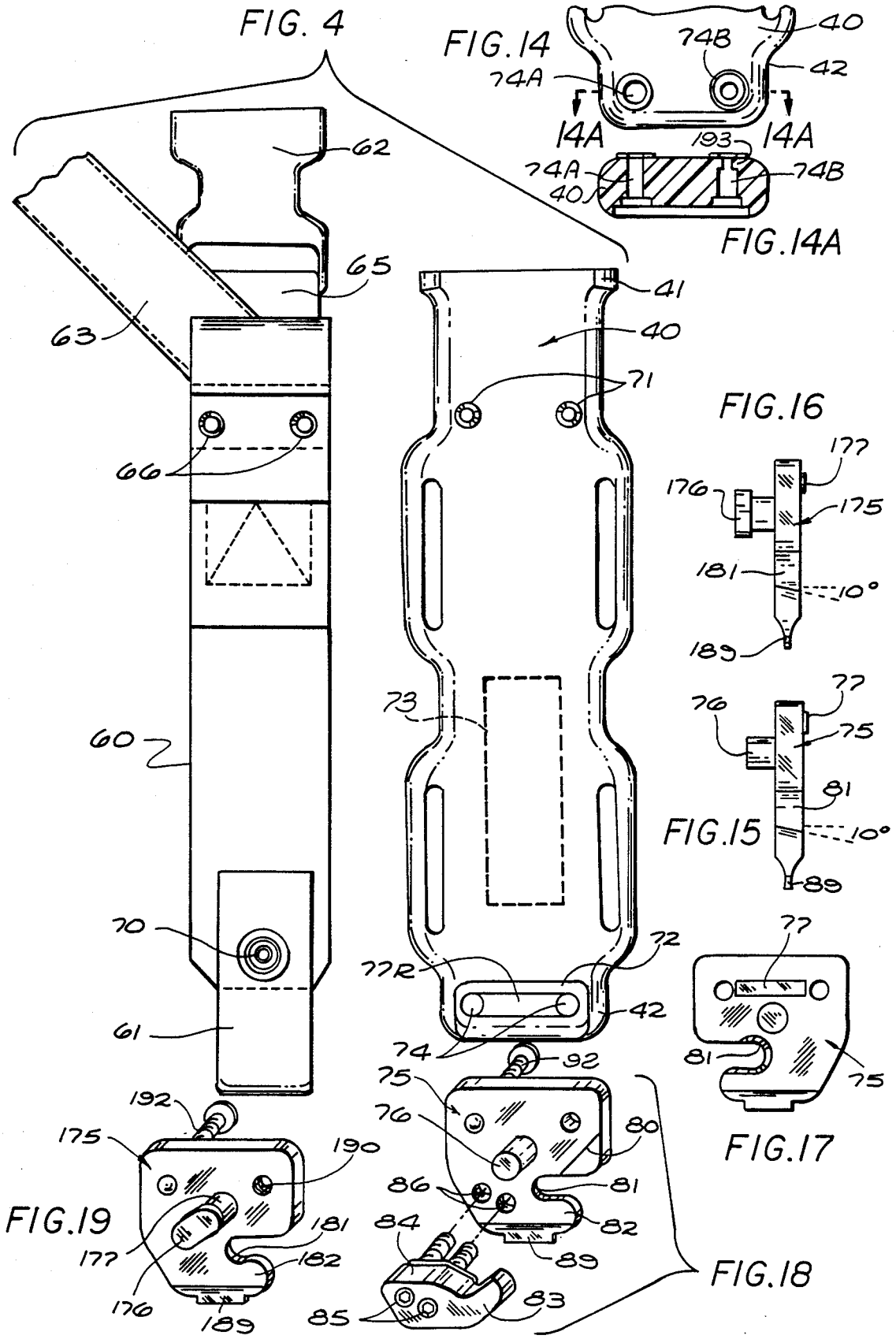
FIG. 4 is an exploded view thereof.
FIG. 14 is a fragmentary elevational view of the bottom end of an alternate embodiment of the scabbard of this invention.
FIG. 14A is a horizontal sectional view of the scabbard of FIG. 14 taken along lines 14A—14A of FIG. 14.
FIG. 15 is a side elevational view of one form of cutter plate of FIG. 3.
FIG. 16 is a side elevational view of an alternate and preferred form of cutter plate of FIG. 3.
FIG. 17 is a rear elevational view of the cutter plate of FIG. 3.
FIG. 18 is an exploded view of the cutter plate and overlying arm of FIG. 3.
FIG. 19 is a perspective view of the alternate of FIG. 16.
Figure 5:
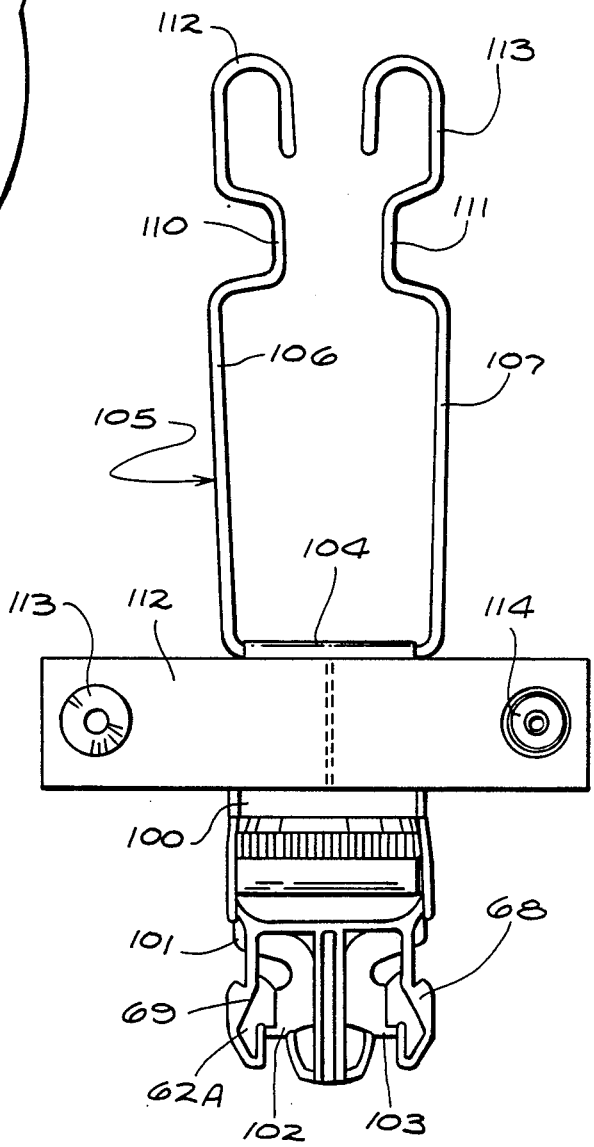
FIG. 5 is a fragmentary view of a preferred form of belt hook for use in connection with this invention.

The scabbard 40, as is best shown in FIG. 4, is supported by a fabric strap 60 including at its lower end a tie down loop 61 and at its upper end, one half of a plastic clip 62, the other half of which is illustrated in FIG. 5. The strap 60 includes a bayonet retainer strap 63 which is sewn at an angle with respect to the length of strap 60 and includes at its end region as shown in FIG. 3 a snap fastener 64 which has its mating part on the front face of the scabbard body and unshown in the drawing. The clip 62 is secured to the strap 60 by an sewn end loop portion 65 of strap 60.

The strap 60 is held to the scabbard body 40 by two machine screws passing through grommets 66 and 70 in the strap. The machine screws engage recessed threaded inserts 71 in the body 40. The lower fastener 72 in actuality is a male half of the snap fastener and the grommet 70 the female half so that the lower end of strap 60 is removably secure to the scabbard 40.

The removable securement of the strap 60 is desirable since the scabbard body 40 in the lower region includes a sharpening stone 73 on the rear face and indicated in FIG. 4 by dashed lines. The sharpening stone 73 is normally covered by the strap 60 but may be uncovered to be used in sharpening the bayonet 10. The sharpening stone 73 lies in a recess in the surface of the scabbard 40 with its surface slightly above the scabbard whereby the bayonet blade may be sharpened by being drawn across the surface of the sharpening stone 73 while the scabbard 40 is held by its upper end.

The lower end 42 of the scabbard 40 includes a pair of holes 74 designed to receive the a cutter plate 75 which is held in place by machine screws which are unshown in the drawing. The cutter plate 75 in one embodiment includes an up standing round circular pin 76 approximately ⅜ of an inch height and threaded into plate 75. An angular cutting surface 80 and a circular recess 81 as well as a rounded cutter region 82 are dimensioned to receive the largest size wire or cable to be cut by the combination of bayonet and scabbard. An overlying finger 83 of stainless steel is secured to the cutter plate 75 by a base portion 84 and a pair of mounting screws unshown in the drawing but extending through matching holes 85 in the finger piece 83 and 86 in the cutter plate. The rear face of cutter plate 75 includes an alignment bar 77 which rests in a meeting recess 77 R of the scabbard as shown in FIG. 4. The alignment bar 77 transfers loading from the cutters plate 75 to the scabbard body 40 during wire cutting.

The finger 83 and the round cutter employing this embodiment portion 82 of the cutter plate 75 embrace the bayonet blade 11 when it is in place for cutting. The cutter plate 75 includes a screw driver blade 89 at its lower end to be used with the scabbard body so acting as a handle.

The operation of the bayonet as a cutter is best seen in FIG. 6 and FIGS. 10–13. The embracing relationship of the finger 83 and the cutter plate 75 is best illustrated in FIG. 13. The presence of the overlying finger 83 insures that a wire or cable does not slip out of cutting engagement without the necessity of a notched blade as in the prior art discussed above.

The Attachable Clip Assembly

Figure 5A:
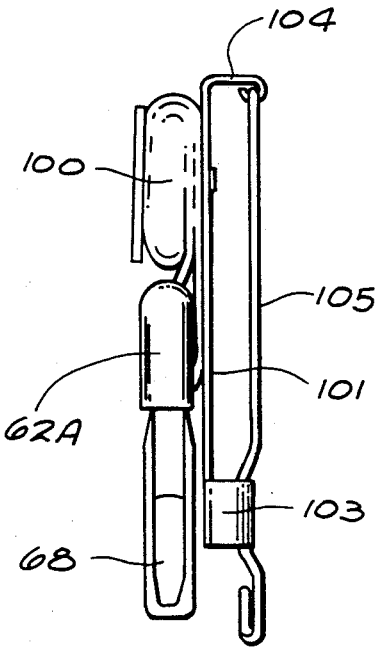
FIG. 5A is a side elevational view of the belt attachment clip assembly of FIG. 5.

The quick detachment arrangement of this invention from the wearers belt is illustrated in FIG. 5 and 5A to which reference is now made. The mating half 62A of the clip 62 of FIG. 4 appears at the bottom of FIG. 5 secured to a strap 100 which, in turn, is secured by rivets, unshown in FIG. 5A of the drawing, to backing plate 101 which constitutes the body of the quick release clip. This clip is of the type disclosed in the U.S. patent to John E. Bianchi, cited above. The body 101 defines a pair of inwardly opening hooks 102 and 103 and at integral hinge tube 104 at the opposite of top end thereof. A spring member 105 including a pair of legs 106 and 107 have inwardly extended ankle portions 110 and 111, respectively, ending in rounded feet portions 112 and 113 which maybe easily grasp by the fingers of the soldier even when wearing heavy mittens. The plate 101 and the spring 105 define a generally rectangular belt opening as illustrated in FIG. 5A. The quick release assembly of this invention is completed by a transverse strap 112 including mating snap fastener parts 113 shown from the rear and 114 from the engaging female side.

In applying this assembly the entire scabbard 40 and its strap 60 may be instantly removed from the belt merely by depressing inwardly the two flexable fingers 68 and 69 of the clip portion 62A.

When the entire assembly is to be removed from the belt. the feet 112 and 113 are compressed inwardly towards each other to release the spring member 105 from its retaining plate 102 and then the entire scabbard, bayonet and quick release assembly maybe removed by lifting the entire assembly upward. The clip assembly maybe used to attach the bayonet and scabbard to various straps in addition to the wearer's belt.

The Bayonet and Scabbard as a Wire or Cable Cutter

The normal use of the bayonet 10 and scabbard 40 is cutting in shown in FIG. 6 in which a double strand of barbed wire 90 is engaged in the cutter and the user is in the act of drawing the scabbard 40 and bayonet 10 together to effect cutting o the barbed wire 90.

Rapid cutting of wire and cable is facilitated in accordance with this invention as illustrated in FIG. 10 in which the blade 11 particularly the cutter edge 16 acts as a guide for the barbed wire 90 to enter the cutting recess 81 of the cutter under the finger 83. By sliding the bayonet blade along the wire to be cut until it reaches the recess 81, then commencing rotational movement of the bayonet 10 and its scabbard 40 serves to first lock the wire or cable 90 in jaws and next complete the cut.

Where the user may be required to cut many strands of wire or use the cutter for a long period of time without being able to sharpen the cutting blade 16 another feature of this invention is incorporated and illustrated in FIGS. 11 and 12. In those figures note that pin 76 does is not include any key hole shape which would limit the longitudinal position of the blade. Instead the opening 21 is elongated so that the blade has nearly a half an inch of longitudinal movement while still presenting an effective cutting edge 16. This prevents undue wear on any localized area of the cutting edge 16. The user need only make a number of the cuts with the blade drawn as far out as the elongated opening 21 will allow and then move the blade forward as illustrated in FIG. 12 for additional cuts on a different portion of the cutting edge 16.

Further facilitating the use of the bayonet 10 and scabbard 40 as a cutter is the fact that the base 84 or the finger 83 defines an OPEN stop 87 in use in FIG. 10 and a CLOSED stop 88 just after completion of cutting. Therefore the finger member 83–84 provides three additional important functions in this invention.

Alternate and Preferred Form of Cutter

Another and preferred form of cutter plate is illustrated in FIGS. 16 and 19. It comprises a cutter plate 175 similar to cutter plate 75 of FIG. 15 with its alignment bar 177 and screw driver blade 189 similar to their counterparts in FIG. 15, upstanding pin 176 includes a head portion, oval in shape corresponding to the oval opening 21 of blade 11. The head of pin 176 holds the blade 11 from separating from the cutter plate 175 during cutting and substitutes for the overlying arm 83 of FIG. 18.

Figure 20:
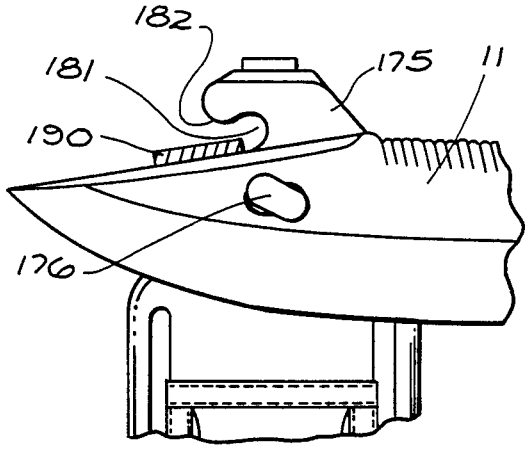
FIGS. 20–22 are fragmentary sequence diagrams showing the cutting of ⅝" stapping employing the alternate embodiment of this invention.
Figure 21:
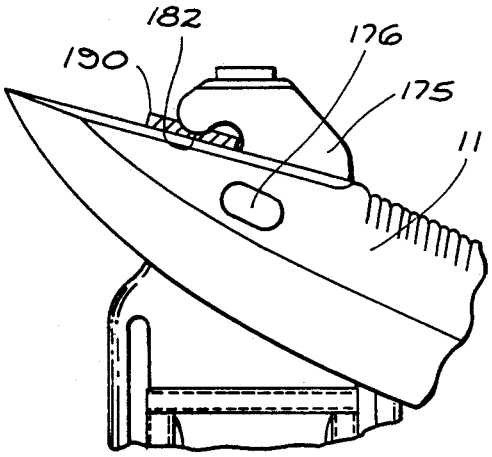
Figure 22:
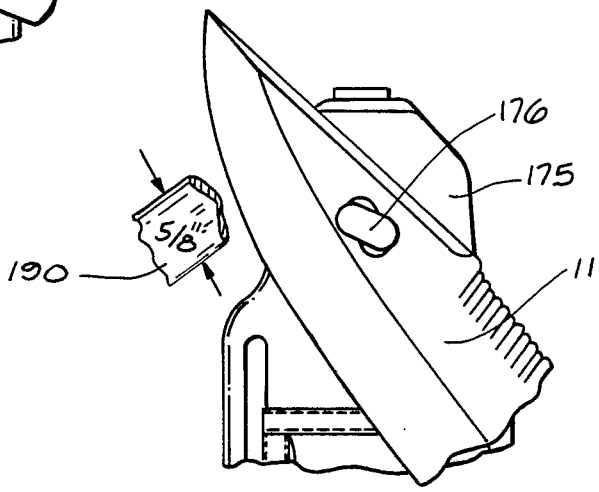

Elimination of the upper arm 83 allows the bayonet and scabbard to cut material such as strapping which is actually wider than the cutter plate opening 181. This is illustrated in FIGS. 20–22 in which a strap 190 is wider than opening 181. Strap 190, typically is a steel strap $\frac{3}{8}''$ in width and used to secure military ammunition boxes as well as palled loaded material.

Employing this invention, the bayonet 10 is engaged with the scabbard 40 as showing in FIG. 20 and the blade 11 slipped under the strap 190. Rotating the blade 11 causes the rounded cutting surface 182 to grasp the wide strap 190 at about its midpoint. This is illustrated in FIG. 21. The concentrated load at this midpoint allows the strap 190 to be pierced at its center region. This action appears in FIG. 21. Completion of the cut appears in FIG. 22.

Where cutting of wide straps as is illustrated in FIGS. 20–22 is required, the embodiment of cutting plate 175 is required. Since it cuts smaller stock as well, it is the preferred embodiment.

BLADE TIGHTENING FEATURE

Also, employing either embodiment of cutter plate, I have incorporated a manual blade tightening feature to insure effective wire and strap cutting. This feature is shown in FIGS. 14, 18 and 19.

FIG. 14 shows the bottom end of the scabbard 40 as having two holes 74 A and 74 B therethrough. They are of different diameter. Hole 74 A provides full clearance for screw 92 and 192 and an upper integral plastic collar 193 which approximately the diameter of the head of screw 92 and 192. The screws 92 and 192 are of sufficient length to extend to the cutting face of the cutter plate 75 and 175 when new. Screws 92 and 192 are located below the blade 11 during wire or strap cutting operation.

If the blade becomes loose after repeated cutting, driving the screw 92 or 192 inward, locally crushes the plastic collar 193 of FIG. 14 and allows the head of the screw 92 or 192 to bear against the cutter plate side of the blade. This holds the blade 11 tight against the finger 83 of FIG. 18 or the head 177 of FIG. 19.

The Bayonet Used as a Saw

Figure 7:
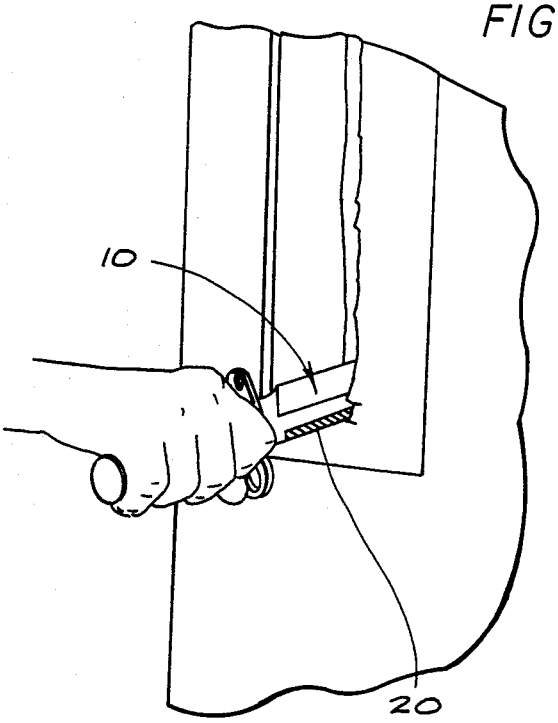
FIG. 7 is a perspective view of this bayonet being used as a saw.

Now referring to FIG. 7 the use of this invention as a saw in clearly illustrated therein. The bayonet 10 is used inverted. Approximately three inches of saw teeth 20 are raked forward at an angle of approximately 10 and recessed even with the upper surface of the blade 11. The saw teeth 20 are tapered from the full blade width at their base to approximately 1/16 inch in thickness at the front edge. This allows rapid cutting through sheet metal and wood while maintaining the full strength of the blade in the central section of nearly one quarter inch thickness.

SUMMARY

All together I have developed an improved bayonet which secures to the end of the military weapon with a conventional bayonet clip to provide a fully functional traditional bayonet. Additionally the bayonet is effective as a saw, a prying tool, a cable or wire cutter when used with its scabbard and as a container opener.

When used as a prying tool the danger of breakage of the blade is greatly reduced not only because of the blade thickness and lack of any notches in the tip region but by reason of the fact that the handle 13 and tang extension 24 cooperate with the blade to provide energy absorption on twisting and deflection at two levels prior to the blade endangering flexing. Altogether, the bayonet and scabbard of my invention provides an effective life saving weapon and tool.

What is claimed is:

1. A bayonet comprising:

a blade;

a tang having an inner end secured to said blade; said tang having a modulus of elasticity lesser than the modulus of elasticity of said blade whereby said tang exhibits greater deformation under loading than said blade;

a handle securable to said blade and means securing said handle to said blade and to the outer end of said tang with clearance between said handle and said tang; and means for attaching said bayonet to the muzzle region of a firearm barrel.

2. The combination in accordance with claim 1 wherein said tang is a rod secured to said blade as an separable extension.

3. The combination in accordance with claim 1 wherein said tang is threadably secured to said blade.

4. The combination in accordance with claim 1 wherein said means securing said handle and tang comprises a threaded member co-acting with the attachment of said tang to said blade for maintaining said tang in tension.

5. A bayonet in accordance with claim 2 wherein said tang and handle have a clearance therebetween at least at one end region of said handle whereby said handle may deform under lateral force as in the case of bending loading of the blade without initial distortion of the tang and indicating a first stress limit condition.

6. A bayonet in accordance with claim 5 wherein the clearance between said tang and said handle is sufficient whereby after a predetermined degree of deformation of said tang, bending deformation of said handle occurs signalling to the user a second stress limit condition prior to blade failure.

7. A bayonet comprising:

a blade including a blade portion and a tang portion a handle including an elongated opening therein dimensioned to receive the tang portion of said blade;

means tensioning said tang portion within said handle;

said handle having a yield strength less than the yield strength of said blade portion whereby on deformation loading applied to said bayonet, said handle deforms prior to deformation of said blade.

8. A bayonet in accordance with claim 7 wherein said tang portion of said blade has a yield strength greater than said handle and less than said blade portion of said blade.

9. A bayonet in accordance with claim 7 wherein the opening in said handle exhibits clearance with said tang whereby said handle may deform under loading prior to engagement with said tang portion.

10. A bayonet in accordance with claim 7 wherein said tang portion of said blade is separable therefrom.

11. A bayonet in accordance with claim 10 wherein said separable tang portion is in threaded engagement with the blade portion of said blade.

12. A bayonet in accordance with claim 7 wherein said tang portion extends through said handle; and said bayonet includes means engaging said handle and said blade tensioning said tang portion.

13. A bayonet in accordance with claim 12 including spacer means between said tang portion and said blade portion of said blade and wherein said tang portion is tensioned between said spacer means and said handle engaging means.

14. A bayonet in accordance with claim 13 wherein said spacer means extends transverse to the length of said blade and constitutes a finger guard.

15. A bayonet in accordance with claim 9 wherein said clearance toward the blade portion end of said handle to greater toward the outer end of said handle.

16. A bayonet-scabbard wire cutter comprising a bayonet including a blade and handle said bayonet blade including a wire or cable cutting blade surface and a opening therein in the region of the tip of said blade;

a rigid scabbard including a cutter plate secured thereto in the region of one end of said scabbard;

an upstanding pin secured to said cutting plate;

an edge opening recess in said cutter plate dimensioned to receive a wire or cable to be cut and including an edge of said edge opening recess as a cutting surface for such wire or cable;

said upstanding pin located on said cutter plate with respect to the cutting surface of said edge opening recess whereby the wire cutting blade surface of said blade engages said cutting surface of said cutter plate when said elongated opening encloses said upstanding pin; and an arm secured to said cutter plate overlying said blade when in engagement with said cutting surface whereby said arm engages the blade on the opposite side from said cutter plate and insures close contact between said blade and cutter plate during wire cable cutting.

17. The bayonet-scabbard wire cutter in accordance with claim 16 wherein said arm extends beyond the end of said edge opening recess whereby said arm blade and cutter plate capture a wire or cable therebetween before cutting operation begins.

18. The bayonet-scabbard wire cutter in accordance with claim 16 wherein said arm is supported above the level of said cutter plate by an integral base secured to said cutter plate.

19. The bayonet-scabbard wire cutter in accordance with claim 18 wherein said base defines at least one stop for rotational movement of said blade.

20. The bayonet-scabbard wire cutter in accordance with claim 19 wherein said base includes a pair of surfaces defining both beginning and ending travel stops for said blade during wire or cable cutting.

21. The bayonet-scabbard wire cutter in accordance with claim 16 wherein said upstanding pin of said cutter plate is circular and said opening in said blade is elongated and round ended whereby said blade may be movable longitudinally on said pin to present different cutting surfaces thereon.

22. A bayonet-scabbard wire cutter comprising a bayonet including a blade and handle;

said bayonet blade including a wire or cable cutting blade surface and a opening therein in the region of the tip of said blade;

a rigid scabbard including a cutting plate having a surface thereon located in the region of one end of said scabbard;

an upstanding pin secured to said cutting plate;

an edge opening recess in said cutter surface including a protruding portion and a recess portion, said recessed portion dimensioned to receive a wire or cable to be cut and wherein the edge of said edge opening recess including said protruding portion constitutes a cutting surface for such wire or cable;

said upstanding pin located on said cutter plate with respect to the cutting surface of said edge opening recess whereby the wire cutting blade surface of said blade engages said protruding portion of said edge opening recess surface of said cutter surface when said elongated opening of said blade encloses said upstanding pin.

23. The bayonet-scabbard wire cutter in accordance with claim 22, wherein said protruding portion of said cutter surface comprises a curved cutting edge which serves to capture a wire or cable before cutting operation begins.

24. The bayonet-scabbard wire cutter in accordance with claim 22 wherein said cutter surface is on a separate cutter plate secured to the lower end of said scabbard.

25. The bayonet-scabbard wire cutter in accordance with claim 22 wherein the cutting edge of said blade is straight in the region of said cutter surface of said scabbard whereby the blade cutter portion and said protruding portion of said cutter surface of said scabbard can capture an object to be cut thereby which is wider than the recess of said scabbard.

26. The bayonet-scabbard wire cutter in accordance with claim 22 wherein said scabbard includes adjustable means extending through said cutting surface to bear upon one side of said blade and maintain said blade in adjustable engagement with said scabbard during cutting use.

27. The bayonet-scabbard wire cutter in accordance with claim 26 wherein said adjustable means comprises a mounting screw for said cutting surface.

28. The bayonet-scabbard wire cutter in accordance with claim 24 wherein said cutter plate is secured to said scabbard by at least one mounting screw and said mounting screw is extendable through said cutter plate to engage the blade of said bayonet and to adjust its engagement with said scabbard.

29. A bayonet-scabbard wire cutter in accordance with claim 28 wherein said scabbard is fabricated of a material which is at least partially crushable by said mounting screw when adjusted.

30. In a bayonet-scabbard wire cutter, comprising a bayonet blade having a cutting edge adjacent one edge and a handle at the opposite end, a scabbard having a cutting plate portion adjacent one end thereof, means for pivotally joining said bayonet and scabbard adjacent said one ends thereof for scissor-like movement with respect to each other during which said cutting edge moves across the surface of said cutting plate portion, the improvement comprising a wire-receiving recess extending inwardly from a constricted opening in one edge of said cutting plate portion in the path of the scissor-like movement of said cutting edge;

additionally including a tang having an inner end secured to said blade, a handle securable to said blade and means securing said handle to said blade and to the outer end of said tang with clearance between said handle and said tang;

said tang having a modulus of elasticity lesser than the modulus of the elasticity of said blade whereby said tang exhibited greater deformation under loading than said blade.

31. In a quick detachable bayonet and scabbard assembly including a scabbard and a bayonet removably received therein with a handle projecting from one end thereof, the improvement comprising an attachable clip assembly having means thereon for detachably securing said clip assembly to the projecting handle of the said bayonet and means thereon for detachably securing said clip assembly to said scabbard in which said last mentioned means comprises a fastener including a socket member having oppositely disposed lateral openings, and a clip member receivable within said socket member and having oppositely disposed resilient fingers engageable with said lateral openings and releasable by compressing said resilient fingers of the said oppositely disposed resilient fingers.

* * * * *